US012391514B2

(12) United States Patent
Tanio

(10) Patent No.: US 12,391,514 B2
(45) Date of Patent: Aug. 19, 2025

(54) PAPER TRANSPORT APPARATUS FOR TRANSPORTING PAPER AND IMAGE FORMING APPARATUS INCLUDING THE SAME

(71) Applicant: KYOCERA Document Solutions Inc., Osaka (JP)

(72) Inventor: Koji Tanio, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 4 days.

(21) Appl. No.: 18/662,031

(22) Filed: May 13, 2024

(65) Prior Publication Data

US 2024/0383707 A1 Nov. 21, 2024

(30) Foreign Application Priority Data

May 16, 2023 (JP) ..... 2023-081112

(51) Int. Cl.
*B65H 29/60* (2006.01)
*B65H 5/06* (2006.01)
(Continued)

(52) U.S. Cl.
CPC ..... *B65H 85/00* (2013.01); *B65H 5/062* (2013.01); *B65H 5/26* (2013.01); *B65H 7/20* (2013.01);
(Continued)

(58) Field of Classification Search
CPC . B65H 7/02; B65H 7/20; B65H 29/60; B65H 85/00; B65H 2511/528; G03G 21/1638; G03G 2215/00586; G03G 2215/1675; G03G 2215/00548; G03G 2215/0043; G03G 2215/00438; G03G 2215/00675; G03G 15/23–235; G03G 15/6579; G03G 15/70; G03G 15/703
See application file for complete search history.

(56) References Cited

U.S. PATENT DOCUMENTS 6,926,272 B2 * 8/2005 Carter ..... B65H 7/02 271/301
8,167,304 B2 * 5/2012 Fukazawa ..... B65H 29/58 271/225

(Continued)

FOREIGN PATENT DOCUMENTS

JP H04116061 A 4/1992

*Primary Examiner* — Ernesto A Suarez
(74) *Attorney, Agent, or Firm* — IP Business Solutions, LLC.

(57) ABSTRACT

In a paper transport apparatus, a controller determines recording paper of a first transport path when a solenoid is deactivated, a paper detection member retreats in contact with the recording paper of the first transport path in a state in which a switching guide is switched to a first transport position, a driven rotation member rotates twice according to this retreat, and a sensor does not detect a standby position of the driven rotation member. Moreover, the controller determines a second transport position of the switching guide when the solenoid is activated, the switching guide is switched to the second transport position, the driven rotation member rotates according to this switching, and the sensor does not detect the standby position of the driven rotation member.

5 Claims, 12 Drawing Sheets

(51) Int. Cl.
*B65H 5/26* (2006.01)
*B65H 7/20* (2006.01)
*B65H 85/00* (2006.01)

(52) U.S. Cl.
CPC ..... *B65H 29/60* (2013.01); *B65H 2511/528* (2013.01); *B65H 2513/10* (2013.01); *B65H 2513/50* (2013.01); *B65H 2801/06* (2013.01)

(56) References Cited

U.S. PATENT DOCUMENTS

| | | | | |
|---|---|---|---|---|
| 8,442,421 | B2 * | 5/2013 | Ichiki | G03G 15/6579 399/21 |
| 8,928,898 | B2 * | 1/2015 | Onishi | G03G 15/70 358/3.32 |
| 9,836,000 | B2 * | 12/2017 | Takemoto | G03G 21/1638 |
| 2024/0176273 | A1 * | 5/2024 | Tanio | B65H 7/02 |

* cited by examiner

PAPER TRANSPORT APPARATUS FOR TRANSPORTING PAPER AND IMAGE FORMING APPARATUS INCLUDING THE SAME

INCORPORATION BY REFERENCE

This application claims priority to Japanese Patent Application No. 2023-081112 filed on May 16, 2023, the entire contents of which are incorporated by reference herein.

BACKGROUND

The present disclosure relates to a paper transport apparatus for transporting paper and an image forming apparatus including the same. In particular, the present disclosure relates to technology for switching a paper transport direction.

In an image forming apparatus, recording paper (an example of paper) is transported to an image forming device through a first transport path and the recording paper is ejected into a paper ejection tray through an ejection roller after an image of a manuscript is formed on a front side of the recording paper by the image forming device. Moreover, when an image of the manuscript is formed on a back side of the recording paper, the recording paper is transported to the ejection roller, switchback transport in which the ejection roller is temporarily stopped and reversely rotated is performed, the recording paper is transported in a direction opposite to a previous transport direction, the recording paper returns to the first transport path through a second transport path, the front and back sides of the recording paper are reversed, an image of the manuscript is formed on the back side of the recording paper by the image forming device, and the recording paper is ejected into the paper ejection tray through the ejection roller.

Moreover, there is a paper transport apparatus that transports recording paper from a carrying-in transport path to a reverse transport path, switches a paper transport direction to a reverse direction on the reverse transport path, and transports the recording paper from the reverse transport path to a paper ejection transport path. In order to switch the recording paper transport direction, a first branch pawl and a second branch pawl for switching the paper transport direction to a branch of the carrying-in transport path, the reverse transport path, and the paper ejection transport path are provided and a roller for transporting the paper to the reverse transport path in the reverse direction is provided.

SUMMARY

As an aspect of the present disclosure, technology obtained by further improving the above-described technology is proposed.

According to an aspect of the present disclosure, a paper transport apparatus includes a first transport path, a roller, a second transport path, a switching guide, a first link member, a paper detection member, a second link member, a driven rotation member, a sensor, a drive device, and a controller. The first transport path is configured to guide paper. The roller transports the paper guided through the first transport path. The second transport path is configured to guide the paper transported in a direction opposite to a transport direction on the first transport path according to reverse rotation of the roller. The switching guide is rotationally supported according to a first shaft parallel to the roller and rotated back and forth around the first shaft to switch a transport direction of the paper by moving to either a first transport position for guiding the paper guided through the first transport path to the roller or a second transport position for guiding the paper transported in the opposite direction according to the reverse rotation of the roller to the second transport path. The first link member is rotatably supported by the first shaft, protrudes in a direction perpendicular to the first shaft, and rotates back and forth integrally with the switching guide around the first shaft. The paper detection member is rotatably supported by a second shaft parallel to the first shaft, protrudes toward the first transport path, rotates around the second shaft, and retreats from the first transport path when the paper detection member comes into contact with the paper transported through the first transport path. The second link member is rotatably supported by the second shaft and rotates integrally with the paper detection member around the second shaft when the paper detection member retreats from the first transport path. The driven rotation member is rotatably supported by a third shaft parallel to the first shaft, pressed and rotated by the first link member when the switching guide is switched to the second transport position and the first link member rotates, and pressed and rotated by the second link member when the paper detection member retreats from the first transport path and the second link member rotates. The sensor detects a standby position of the driven rotation member when the driven rotation member is not pressed by either the first link member or the second link member. The drive device rotates the switching guide back and forth around the first shaft and switches the switching guide to either the first transport position or the second transport position. The controller determines that the paper is being transported through the first transport path when the paper detection member retreats in contact with the paper transported through the first transport path in a state in which the switching guide is switched to the first transport position by controlling the drive device, the second link member rotates, the driven rotation member is pressed and rotated by the second link member, and the standby position of the driven rotation member is not detected by the sensor and determines that the switching guide has been switched from the first transport position to the second transport position when the first link member rotates with the switching guide after the switching guide is switched to the second transport position by controlling the drive device, the driven rotation member is pressed and rotated by the first link member, and the standby position of the driven rotation member is not detected by the sensor.

According to an aspect of the present disclosure, an image forming apparatus includes the paper transport apparatus according to the above-described aspect of the present disclosure and an image forming device configured to form an image on the paper transported by the paper transport apparatus.

BRIEF DESCRIPTION OF THE DRAWINGS

FIGS. 2A and 2B are side views showing enlarged versions of an ejection roller and a switching guide in the paper transport apparatus of the present embodiment, wherein FIG. 2A shows a first transport position of the switching guide when recording paper is guided to the ejection roller and FIG. 2B shows a second transport position of the switching guide when the recording paper transported in the opposite direction by the ejection roller is guided.

FIGS. 4A and 4B schematically show an example of a mechanism for rotating each switching guide and the first link member back and forth, wherein FIG. 4A shows a state in which each switching guide is moved to the first transport position and FIG. 4B shows a state in which each switching guide is moved to the second transport position.

DETAILED DESCRIPTION

Figure 1:
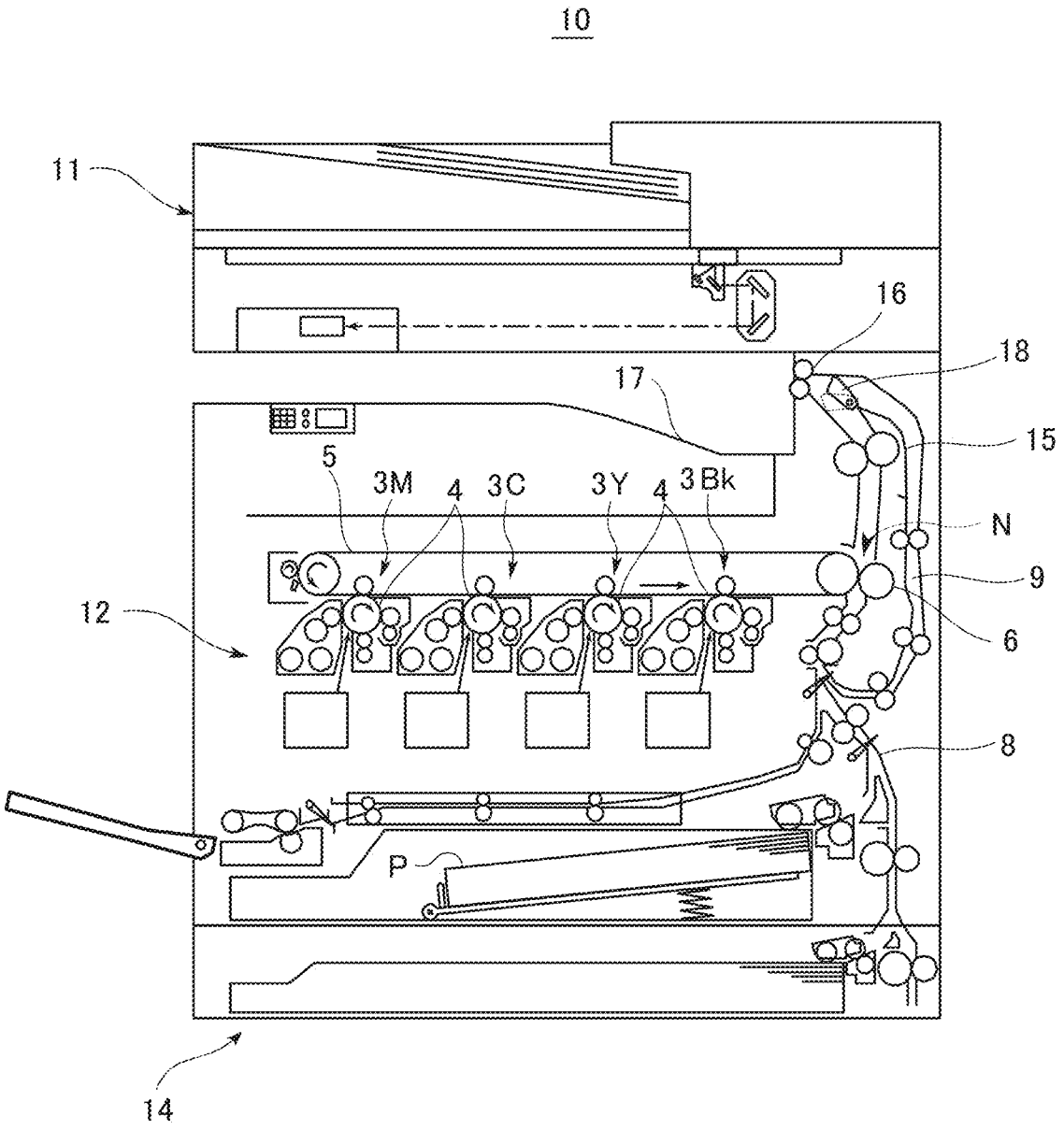
FIG. 1 is a cross-sectional view showing an image forming apparatus to which a paper transport apparatus of an embodiment according to the present disclosure is applied.

Hereinafter, embodiments of the present disclosure will be described with reference to the drawings. Hereinafter, a rotational direction or left, right, up, and down directions may be shown, but these are the directions of the examples in each drawing unless otherwise stated. FIG. 1 is a cross-sectional view showing an image forming apparatus to which a paper transport apparatus of an embodiment according to the present disclosure is applied. As shown in FIG. 1, an image forming apparatus 10 of the present embodiment includes an image reading device 11 and an image forming device 12.

The image reading device 11 includes an image sensor (a CCD sensor or a contact image sensor) that optically reads an image of a manuscript and an output of the image sensor is converted into image data.

The image forming device 12 prints an image indicated in the above-described image data on recording paper and includes an image forming unit 3M for magenta, an image forming unit 3C for cyan, an image forming unit 3Y for yellow, and an image forming unit 3Bk for black. In any one of the image forming units 3M, 3C, 3Y, and 3Bk, a surface of a photoreceptor drum 4 is uniformly charged, the surface of the photoreceptor drum 4 is exposed, an electrostatic latent image is formed on the surface of the photoreceptor drum 4, the electrostatic latent image on the surface of the photoreceptor drum 4 is developed into a toner image, and the toner image on the surface of the photoreceptor drum 4 is transferred to an intermediate transfer belt 5. Thereby, a colored toner image is formed on the intermediate transfer belt 5. This colored toner image is secondarily transferred to recording paper P transported from a paper feed device 14 through the first transport path 8 in a nip region N between the intermediate transfer belt 5 and a secondary transfer roller 6.

Subsequently, the recording paper P is heated and pressurized by a fixing device 15 to fix the toner image on the recording paper P through thermocompression bonding, and the recording paper P is ejected into a paper ejection tray 17 through an ejection roller 16.

Moreover, when the image of the manuscript is recorded on the back side of the recording paper P, switchback transport in which the recording paper P is transported to the ejection roller 16 in front of the paper ejection tray 17, the ejection roller 16 is temporarily stopped and then reversely rotated, and the recording paper P is transported in the reverse direction is performed, the position of the switching guide 18 provided at a branch position of the first transport path 8 and the second transport path 9 is switched, the recording paper P is guided from the ejection roller 16 to a second transport path 9, the recording paper P returns to the first transport path 8 through the second transport path 9, the front and back sides of the recording paper P are reversed, the image forming device 12 forms the image of the manuscript on the back side of the recording paper P, and the recording paper P is ejected into the paper ejection tray 17 through the ejection roller 16.

Figure 2A:
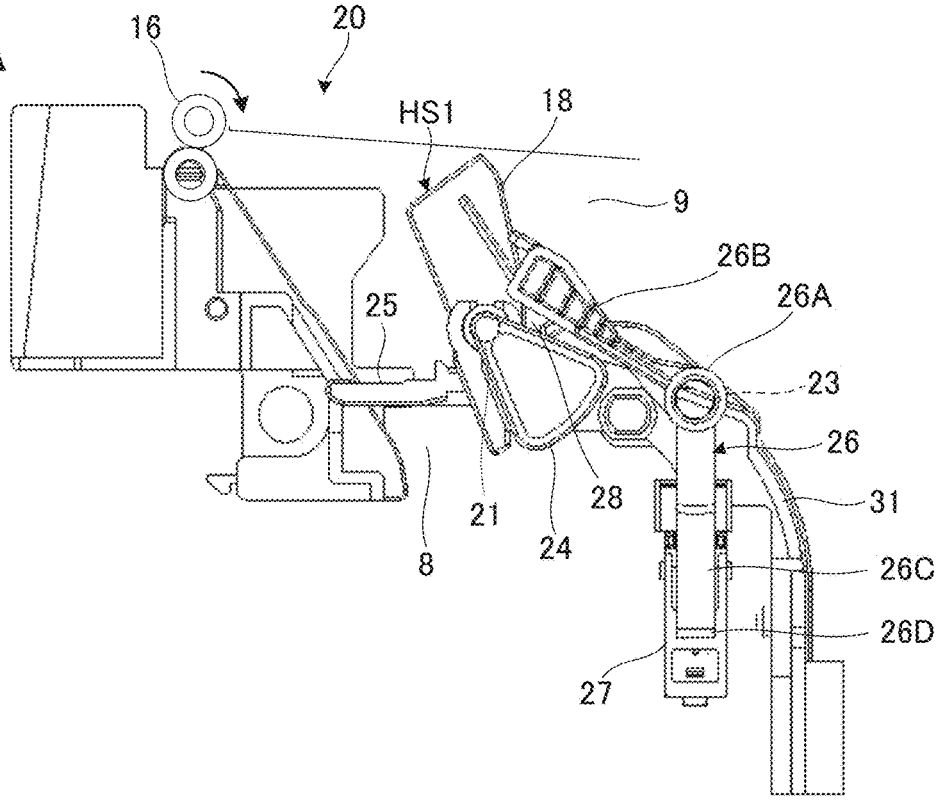
Figure 2B:
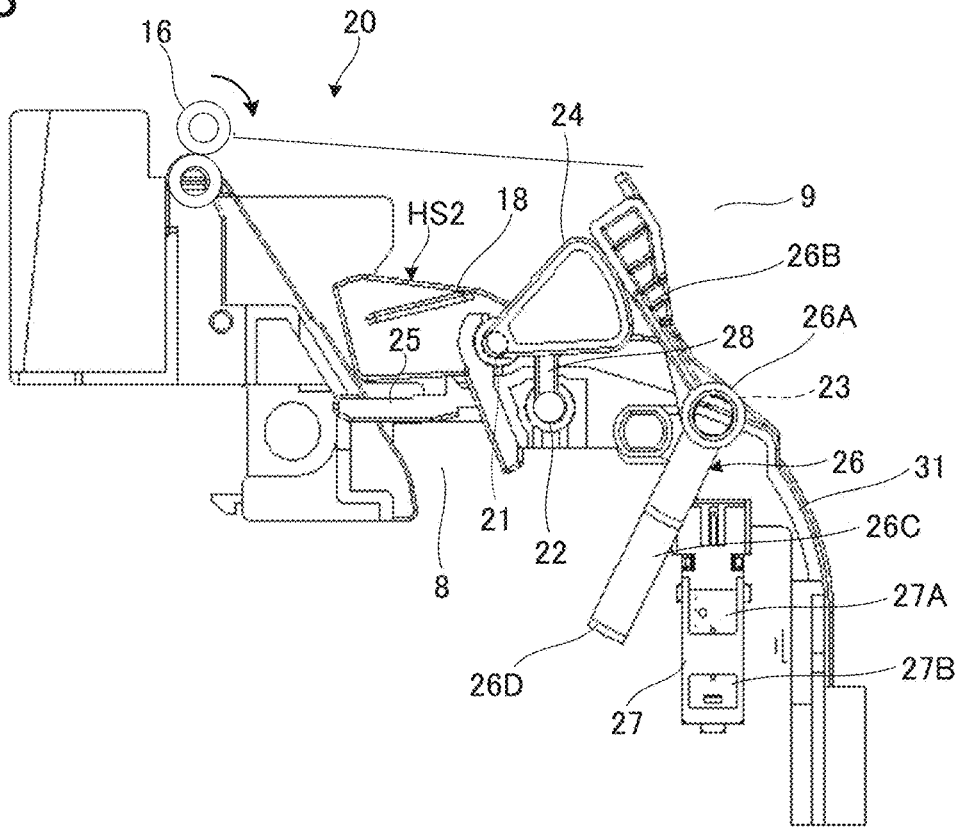

FIGS. 2A and 2B are side views showing enlarged versions of the periphery of the ejection roller 16 and the switching guide 18 in the paper transport apparatus 20 of the present embodiment. As shown in FIGS. 2A and 2B, the switching guide 18 is rotatably supported by a shaft 21 (a first shaft in the claims) parallel to the ejection roller 16 and is switched to a first transport position HS1 or a second transport position HS2 and positioned. In a state in which the switching guide 18 is positioned at the first transport position HS1, the recording paper is transported from the fixing device 15 (shown in FIG. 1) to the ejection roller 16 through the first transport path 8 and ejected into the paper ejection tray 17 (shown in FIG. 1) from the ejection roller 16.

When the above-described switchback transport is performed, after the rear end of the recording paper passes through the switching guide 18 during the transportation of the recording paper by the ejection roller 16, the ejection roller 16 is temporarily stopped when the ejection roller 16 is nipping the recording paper. The switching guide 18 is switched from the first transport position HS1 to the second transport position HS2 and the ejection roller 16 is reversely rotated. The recording paper is transported by the ejection roller 16 in a direction opposite to the previous transport direction and is guided to the second transport path 9 by the switching guide 18 at a branch position of the first transport path 8 and the second transport path 9. Also, the recording paper returns to the first transport path 8 through the second transport path 9, and the front and back sides of the recording paper are reversed.

As shown in FIGS. 2A and 2B, a first link member 24, a paper detection member 25, a driven rotation member 26, a sensor 27, a second link member 28, and the like are provided around the switching guide 18 and the shaft 21. The paper detection member 25 is rotatably supported by a shaft 22 (a second shaft in the claims) parallel to the shaft 21 and is provided to detect recording paper transported through the first transport path 8. The paper detection member 25 protrudes on the first transport path 8 side, and its tip enters a recess formed in the wall of the first transport path 8.

The driven rotation member 26 is rotatably supported by a shaft 23 (a third shaft in the claims) parallel to the shaft 21. The driven rotation member 26 includes a bearing device 26A rotatably supported by the shaft 23, a contact arm 26B and a swing arm 26C connected and fixed to the bearing device 26A, and a detected piece 26D bent inward and protruding at a lower end of the swing arm 26C. The contact arm 26B and the swing arm 26C have a bent shape at a position of the bearing device 26A.

The sensor 27 is an optical sensor in which a light emitting element 27A and a light receiving element 27B are arranged facing each other in the up/down direction and the detected piece 26D at the lower end of the swing arm 26C that penetrates between the light emitting element 27A and the light receiving element 27B is detected.

The shaft 21 for supporting the switching guide 18 is rotatably supported by a frame 31 inside the paper transport apparatus 20. Likewise, the shaft 22 for supporting the paper detection member 25 is rotatably supported by the frame 31 inside the paper transport apparatus 20. Moreover, the shaft 23 for supporting the driven rotation member 26 protrudes inward from an inner wall (not shown) of a housing of the paper transport apparatus 20 and is inserted into the bearing device 26A of the driven rotation member 26. The shaft 23 rotatably supports the driven rotation member 26 around the shaft 23.

Figure 3:
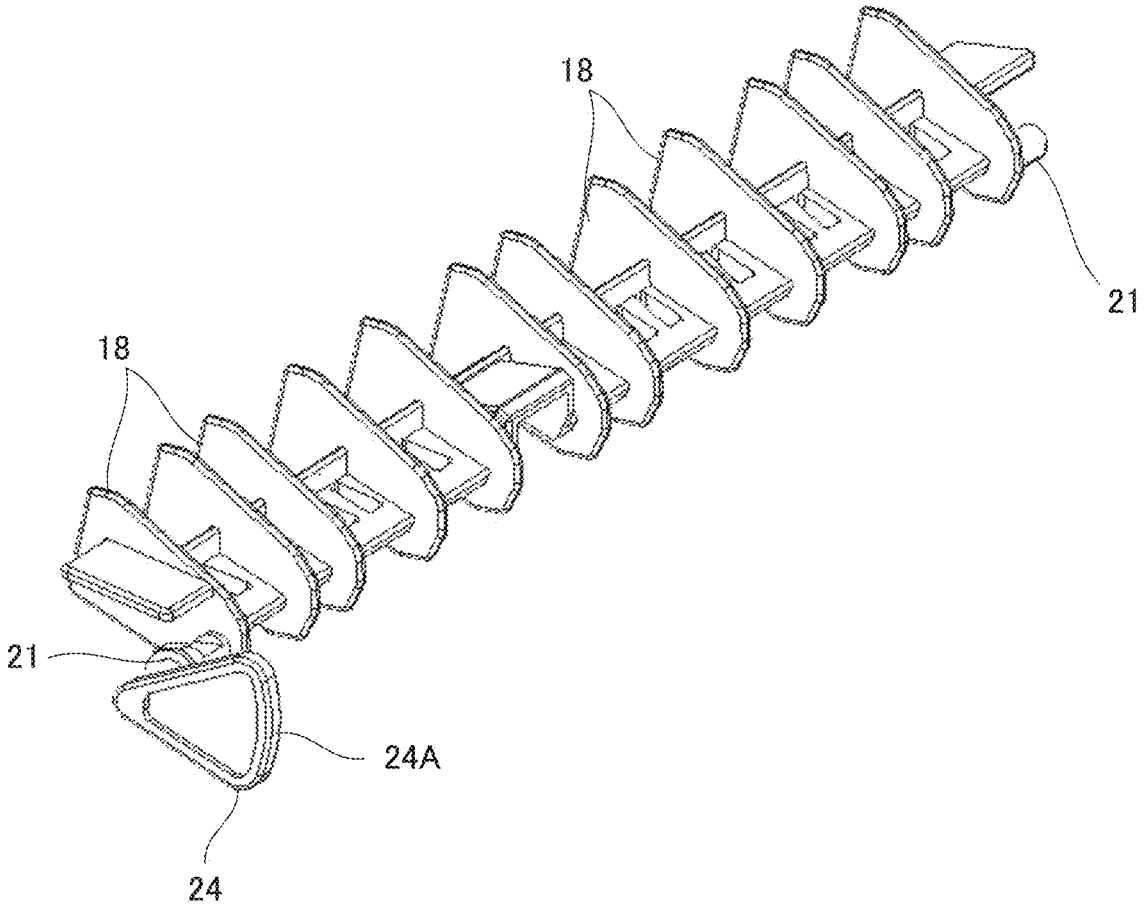
FIG. 3 is a perspective view showing each switching guide, the first link member, and a shaft for rotatably supporting each switching guide and the first link member.

FIG. 3 is a perspective view showing the switching guide 18, the shaft 21, and the like. As shown in FIG. 3, a plurality of switching guides 18 are provided at intervals in a width direction of the recording paper and each switching guide 18 is fixed to the shaft 21. Moreover, the first link member 24 protruding in a direction perpendicular to the shaft 21 is fixed to one end of the shaft 21. The first link member 24 is a fan shape extending from the shaft 21 and has a sliding contact surface 24A that draws a smooth arc on the outer circumference of the fan shape. When the shaft 21 is rotated back and forth, each switching guide 18 and the first link member 24 are integrally rotated back and forth around the shaft 21 and each switching guide 18 is switched to the first transport position HS1 or the second transport position HS2.

Figure 4A:
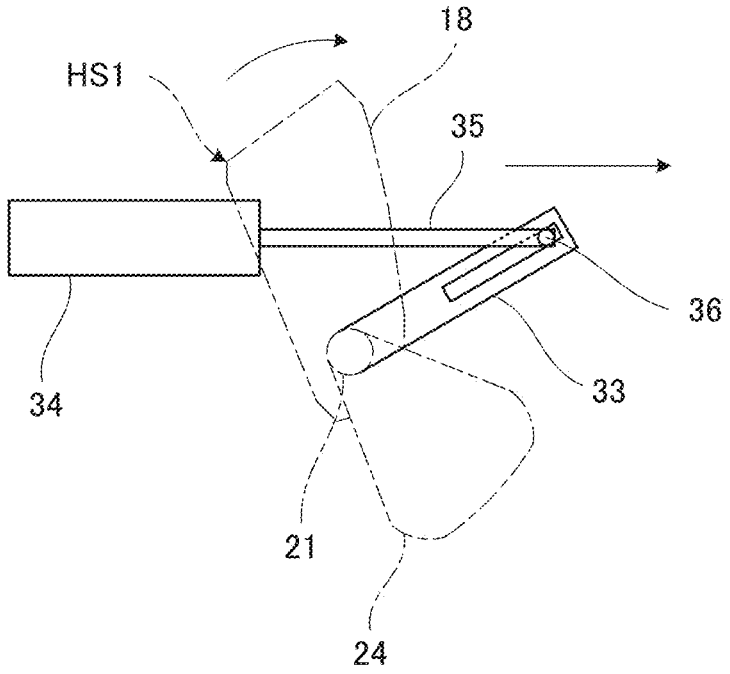
Figure 4B:
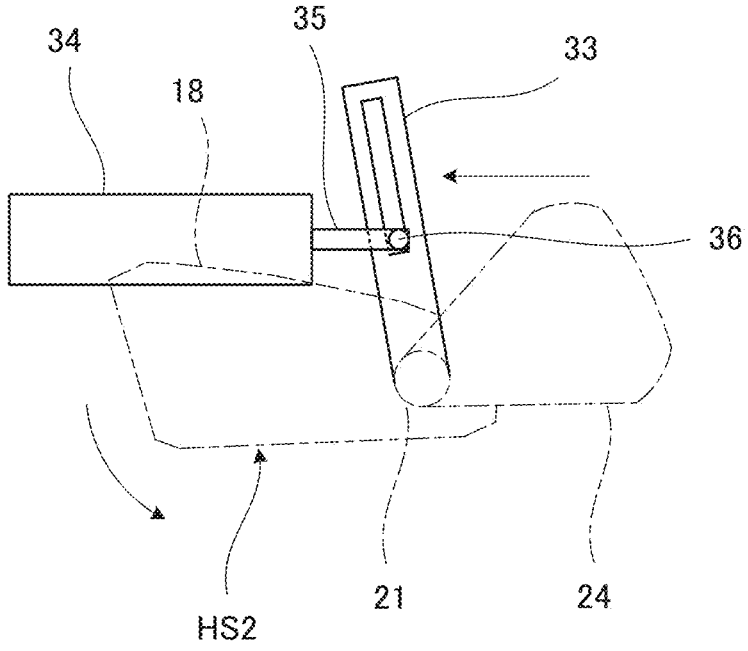

FIGS. 4A and 4B are views showing an example of a mechanism for rotating each switching guide 18 and the first link member 24 back and forth around the shaft 21. As shown in FIGS. 4A and 4B, a guide member 33 is connected and fixed to one end of the shaft 21 in a direction perpendicular to the shaft 21 and a pin 36 provided at the tip of a plunger 35 of a solenoid 34 is inserted into a groove of the guide member 33. Moreover, the guide member 33 is biased by a spring (not shown) in a clockwise direction centered on the shaft 21. When the solenoid 34 is deactivated, the guide member 33 is biased by the spring in the clockwise direction and the plunger 35 follows the guide member 33 and protrudes from the solenoid 34. Simultaneously, each switching guide 18 and the first link member 24 rotate in the clockwise direction and each switching guide 18 is positioned at the first transport position HS1.

Moreover, when the solenoid 34 is activated and driven, the solenoid 34 pulls the plunger 35 against a biasing force of the spring, and the guide member 33 follows the plunger 35 and rotates in a counterclockwise direction. Simultaneously, each switching guide 18 and the first link member 24 rotate in the counterclockwise direction and each switching guide 18 is positioned at the second transport position HS2.

Figure 5:
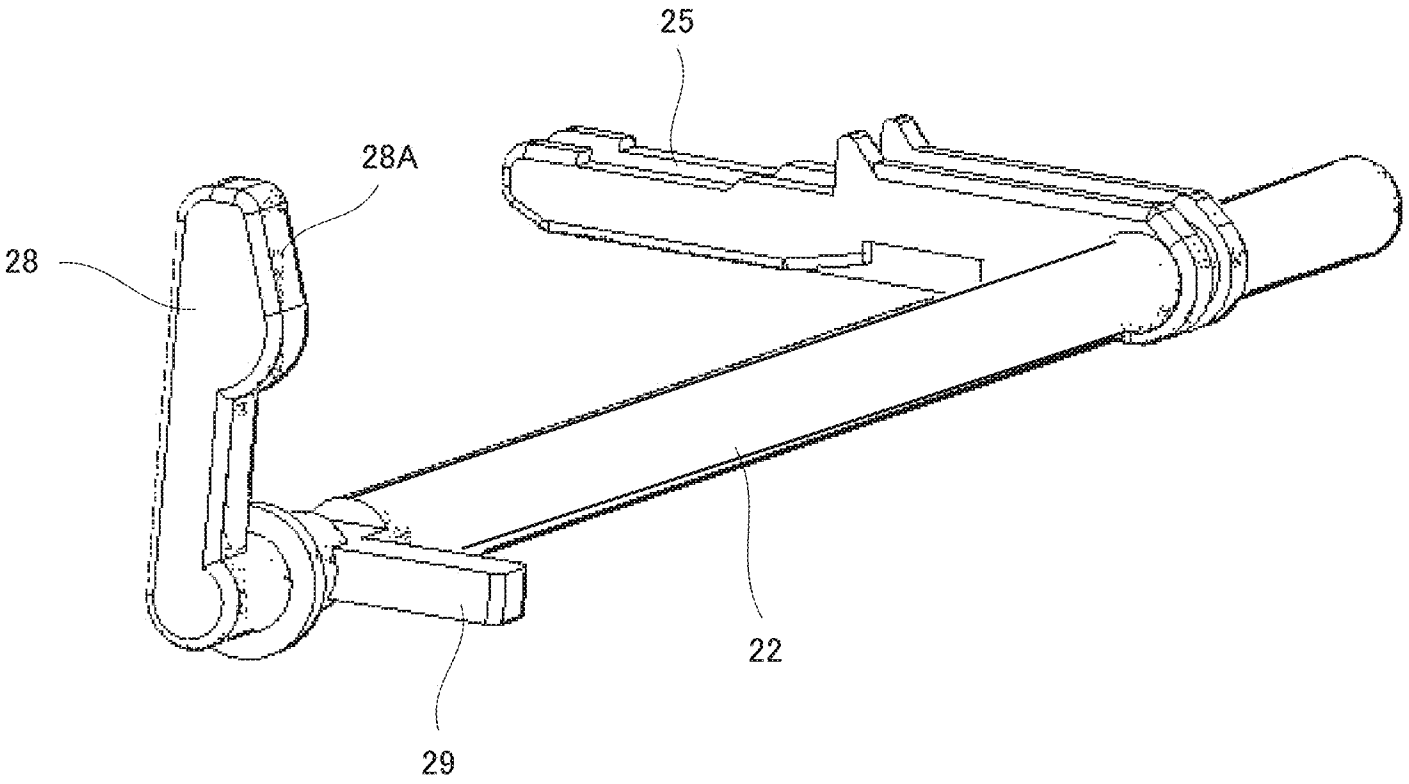
FIG. 5 is a perspective view showing a shaft that rotatably supports a paper detection member, a second link member, a paper detection member, and a second link member.

FIG. 5 is a perspective view showing the paper detection member 25, the shaft 22, and the like. As shown in FIG. 5, the paper detection member 25 is connected to a portion of the shaft 22 separated from one end of the shaft 22 and protrudes from a position between the switching guides 18 to the first transport path 8 side at approximately the center of the shaft 21 for supporting each switching guide 18 shown in FIG. 3. The second link member 28 and a stopper 29 protruding in a direction orthogonal to the shaft 22 are fixed to one end of the shaft 22, the second link member 28 protrudes upward, the stopper 29 protrudes in a direction opposite to the paper detection member 25, and the second link member 28 and the stopper 29 are oriented in directions whose difference is approximately 90°. The second link member 28 is rod-shaped and has a sliding contact surface 28A that draws a smooth arc on a rod-shaped side surface. When the paper detection member 25 is rotated back and forth around the shaft 22, the paper detection member 25, the second link member 28, and the stopper 29 are integrally rotated back and forth.

Figure 6A:
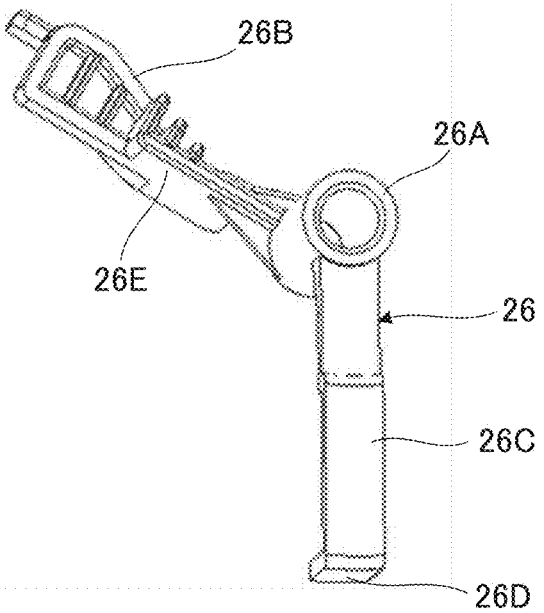
FIGS. 6A and 6B are a perspective view showing a driven rotation member seen from the front side and a perspective view showing the driven rotation member seen from the back side.
Figure 6B:
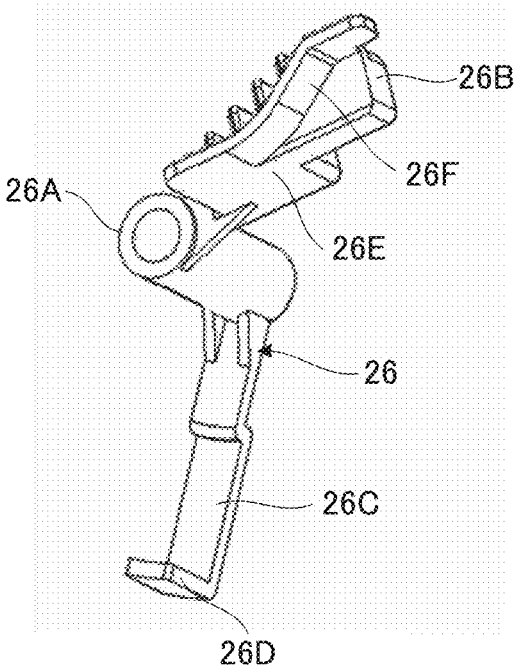

FIGS. 6A and 6B are a perspective view showing the driven rotation member 26 seen from the front side and a perspective view showing the driven rotation member 26 seen from the back side. As shown in FIGS. 6A and 6B, the driven rotation member 26 includes the bearing device 26A, the contact arm 26B, the swing arm 26C, and the detected piece 26D protruding inward from the lower end of the swing arm 26C. The contact arm 26B has a smooth surface 26E facing downward in contact with the sliding contact surface 24A of the first link member 24 fixed to one end of the shaft 21. Moreover, the contact arm 26B has a bent inclined surface 26F facing downward in contact with the sliding contact surface 28A of the second link member 28 fixed to one end of the shaft 22.

As shown in FIGS. 2A and 2B, the first link member 24 fixed to the one end of the shaft 21 and the second link member 28 fixed to the one end of the shaft 22 are located inside and outside, i.e., the smooth surface 26E of the contact arm 26B in contact with the sliding contact surface 24A of the first link member 24 is located outside, the bent inclined surface 26F of the contact arm 26B in contact with the sliding contact surface 28A of the second link member 28 is located inside, and the smooth surface 26E and the sliding contact surface 28A are adjacent to each other inside and outside.

Figure 7A:
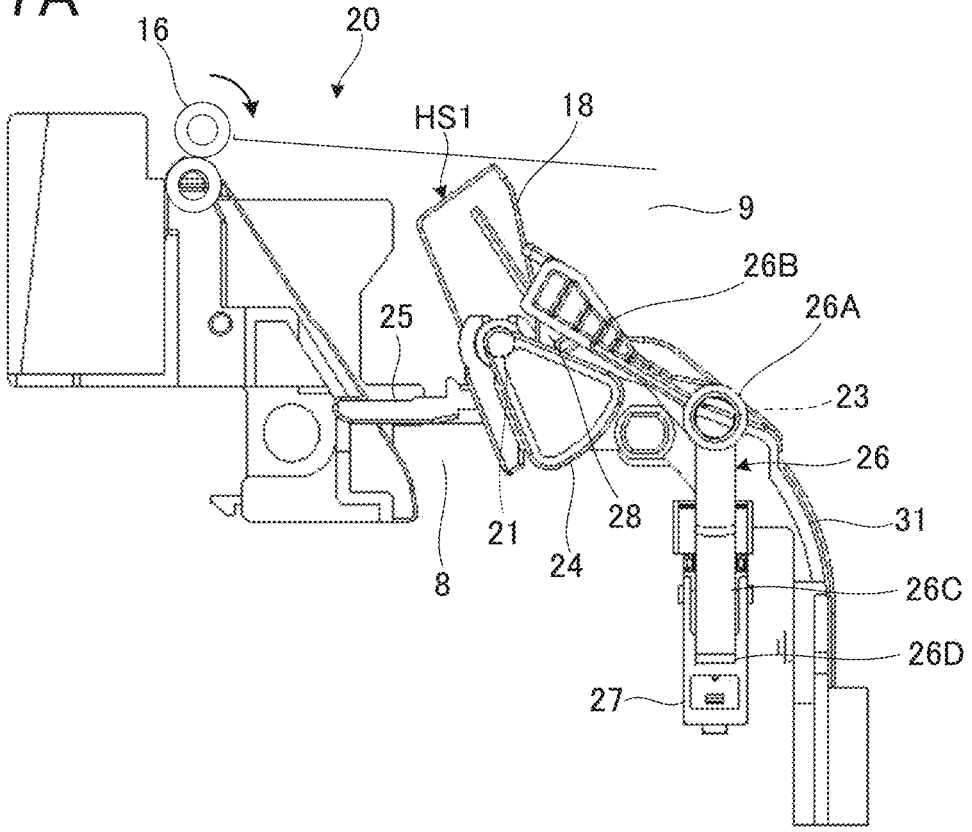
FIGS. 7A and 7B are a side view showing the first link member, the paper detection member, the driven rotation member, a sensor, and the second link member in a state in which each switching guide is moved to the first transport position and the recording paper is not being transported through the first transport path and a side view schematically showing the state.
Figure 7B:
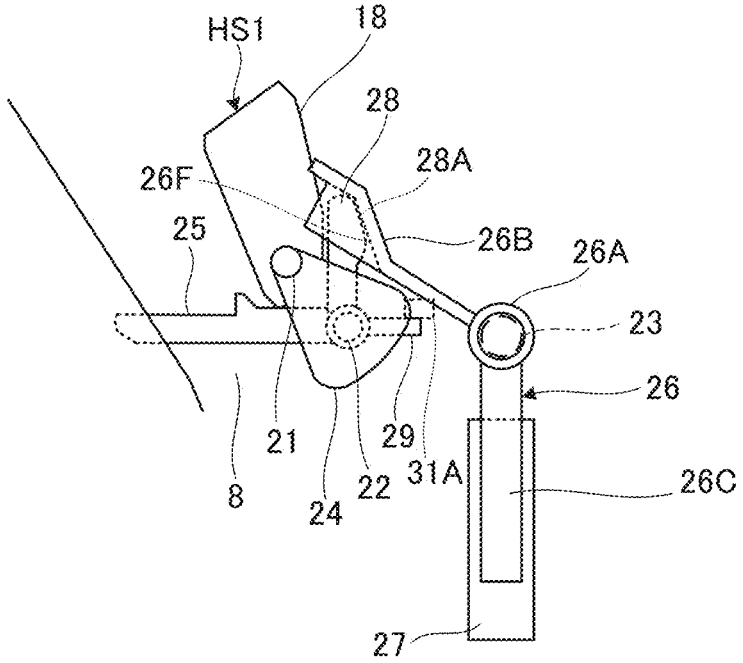

FIGS. 7A and 7B are a side view showing the first link member 24, the paper detection member 25, the driven rotation member 26, the sensor 27, and the second link member 28 in a state in which each switching guide 18 is moved to the first transport position HS1 and the recording paper is not being transported through the first transport path 8 and a side view schematically showing the first link member 24, the paper detection member 25, the driven rotation member 26, the sensor 27, and the second link member 28 in the state.

When the solenoid 34 is deactivated as shown in FIGS. 4A, each switching guide 18 and the first link member 24 rotate in a clockwise direction around the shaft 21 and each switching guide 18 is positioned at the first transport position HS1 as shown in FIGS. 7A and 7B.

The paper detection member 25 is biased and rotated in the counterclockwise direction around the shaft 22 due to its weight and the tip of the paper detection member 25 enters the recess formed in the wall of the first transport path 8. At this time, the stopper 29 rotates in the counterclockwise direction around the shaft 22 and stops in contact with a part 31A of the frame 31 inside the paper transport apparatus 20, the paper detection member 25 stops in a substantially horizontal direction, and the second link member 28 stops facing upward.

The driven rotation member 26 is biased and rotated in the counterclockwise direction around the shaft 23 due to its weight and the bent inclined surface 26F of the contact arm 26B of the driven rotation member 26 is in contact with the sliding contact surface 28A of the second link member 28 and the driven rotation member 26 stops. At this time, the swing arm 26C of the driven rotation member 26 stops facing downward and the sensor 27 detects the detected piece 26D of the swing arm 26C.

Therefore, when the swing arm 26C of the driven rotation member 26 is facing downward and the driven rotation member 26 is at a preset standby position, the sensor 27 detects the detected piece 26D at the lower end of the swing arm 26C.

Figure 8A:
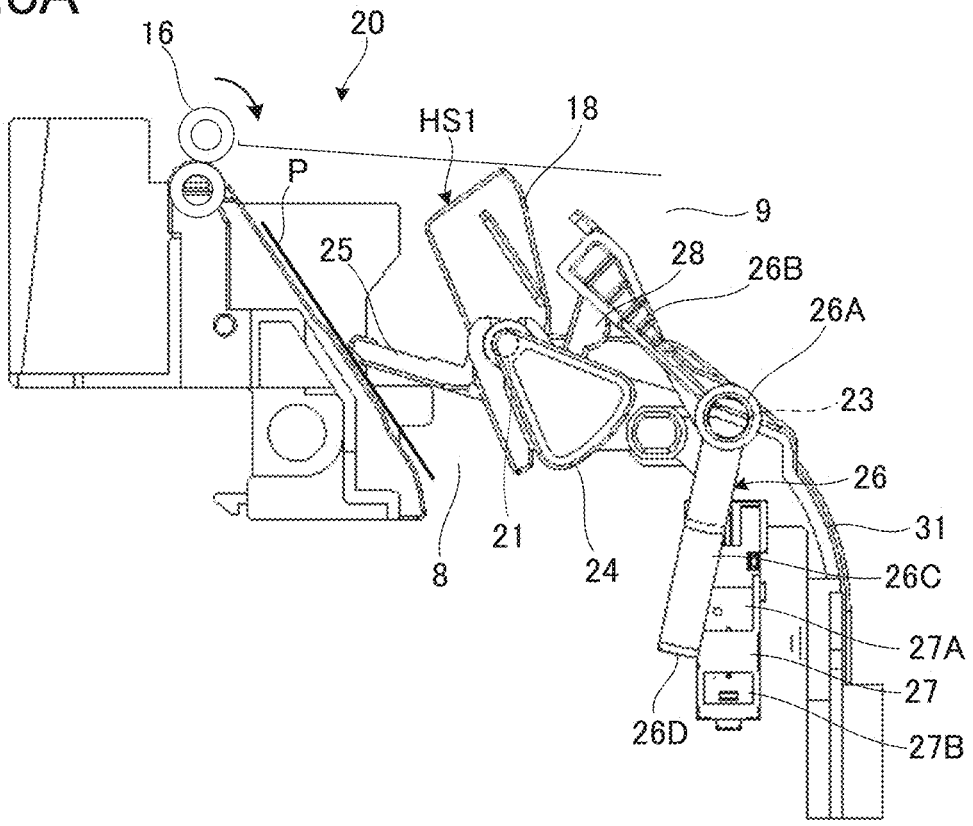
FIGS. 8A and 8B are a side view showing the first link member, the paper detection member, the driven rotation member, the sensor, and the second link member in a state in which each switching guide is moved to the first transport position and the recording paper is being transported through the first transport path and a side view schematically showing the state.
Figure 8B:
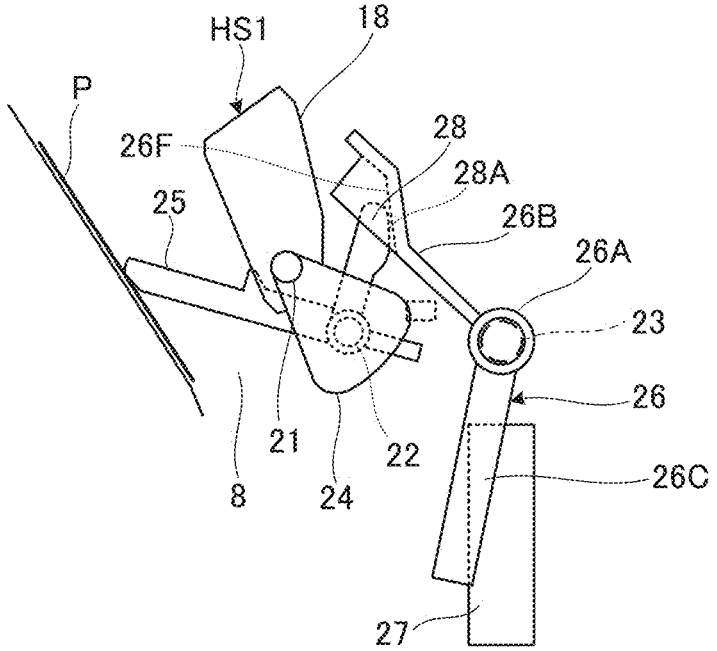

FIGS. 8A and 8B are a side view showing the first link member 24, the paper detection member 25, the driven rotation member 26, the sensor 27, and the second link member 28 in a state in which each switching guide 18 is moved to the first transport position HS1 and the recording paper is being transported through the first transport path 8 and a side view schematically showing the first link member 24, the paper detection member 25, the driven rotation member 26, the sensor 27, and the second link member 28 in the state. Moreover, FIG. 9 is a side view showing the first link member 24, the paper detection member 25, the driven rotation member 26, the sensor 27, and the second link member 28 seen from the back side in the same state as FIGS. 8A and 8B.

Figure 9:
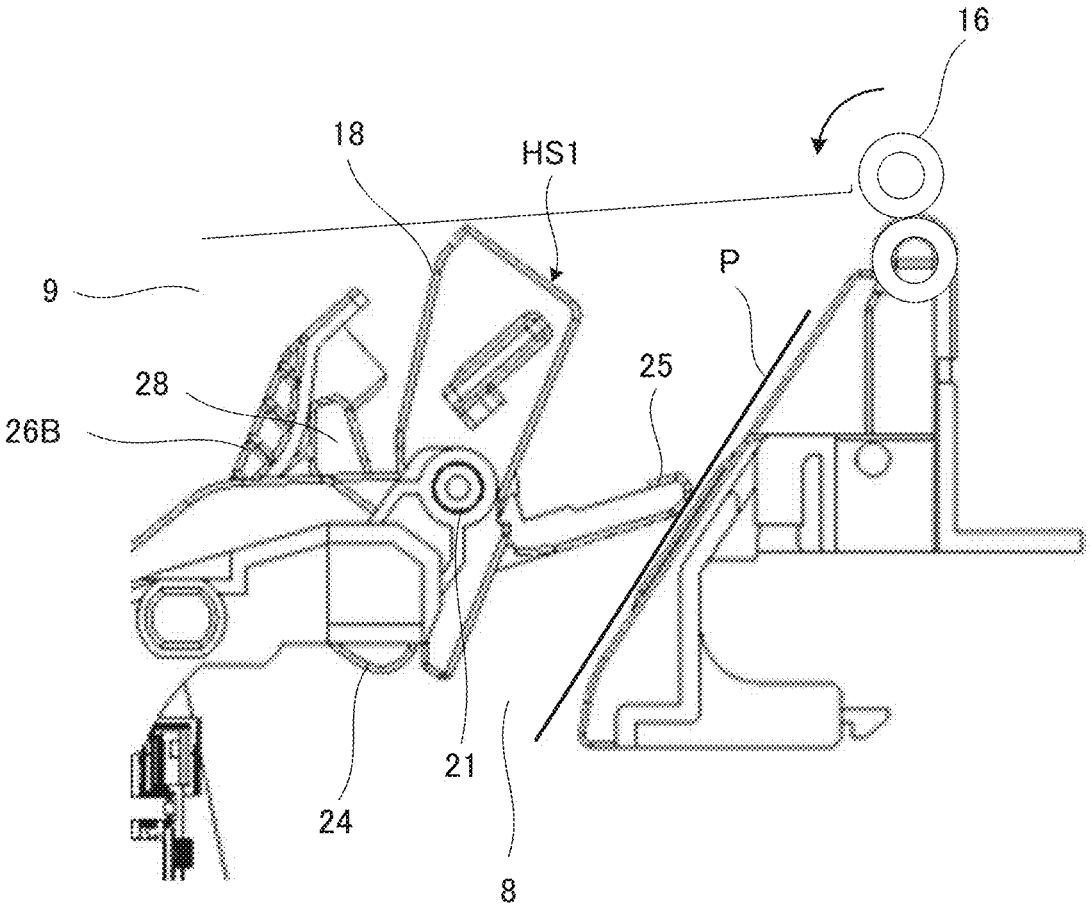
FIG. 9 is a side view showing the first link member, the paper detection member, the driven rotation member, the sensor, and the second link member seen from the back side in the same state as FIGS. 8A and 8B.

A state in which the solenoid 34 is deactivated is maintained as shown in FIG. 4A and each switching guide 18 is positioned at the first transport position HS1 as shown in FIGS. 8A, 8B, and 9.

When the recording paper P is transported through the first transport path 8, the tip of the paper detection member 25 is pushed up in contact with the recording paper P, the paper detection member 25 rotates in the clockwise direction around the shaft 22, and the second link member 28 also rotates in the clockwise direction. At this time, the sliding contact surface 28A of the second link member 28 pushes away the bent inclined surface 26F of the contact arm 26B of the driven rotation member 26 in a right direction, the driven rotation member 26 rotates in the clockwise direction around the shaft 23, and the detected piece 26D of the swing arm 26C of the driven rotation member 26 is removed from a detection position of the sensor 27.

Therefore, in the state in which the recording paper P is transported through the first transport path 8, the driven rotation member 26 is at a position outside the standby position and the sensor 27 does not detect the detected piece 26D at the lower end of the swing arm 26C.

Figure 10A:
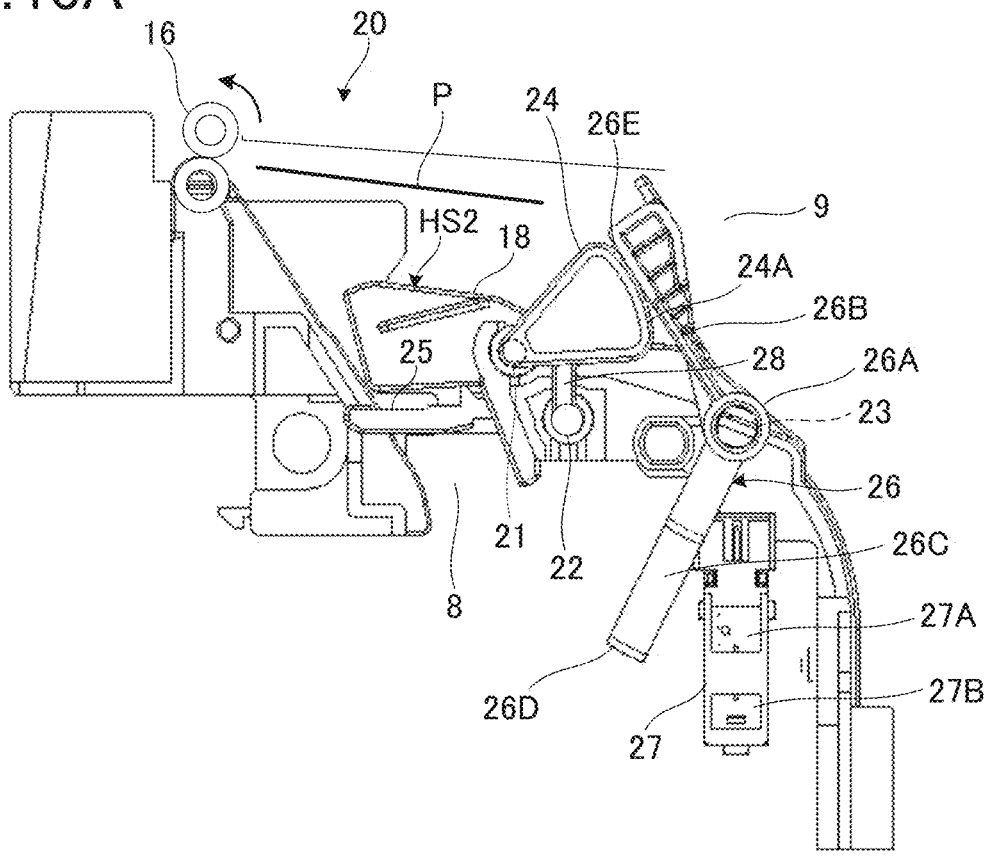
FIGS. 10A and 10B are a side view showing the first link member, the paper detection member, the driven rotation member, the sensor, and the second link member in a state in which each switching guide has been moved from the first transport position to the second transport position and a side view schematically showing the state.
Figure 10B:
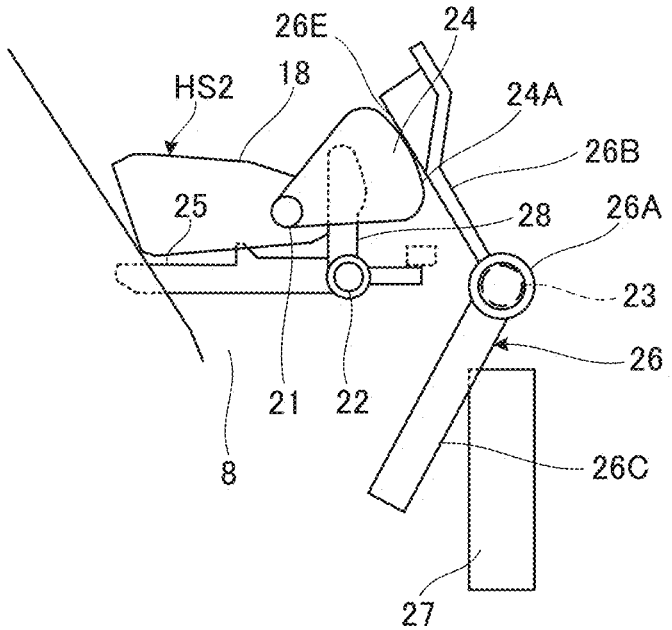

FIGS. 10A and 10B are a side view showing the first link member 24, the paper detection member 25, the driven rotation member 26, the sensor 27, and the second link member 28 in a state in which each switching guide 18 is moved from the first transport position HS1 to the second transport position HS2 and a side view schematically showing the first link member 24, the paper detection member 25, the driven rotation member 26, the sensor 27, and the second link member 28 in the state.

When the solenoid 34 is activated as shown in FIG. 4B, each switching guide 18 and the first link member 24 rotate in the counterclockwise direction around the shaft 21 and each switching guide 18 is positioned at the second transport position HS2 as shown in FIGS. 10A and 10B.

When the first link member 24 rotates in the counterclockwise direction, the sliding contact surface 24A of the first link member 24 pushes away the smooth surface 26E of the contact arm 26B of the driven rotation member 26 in the right direction, the driven rotation member 26 rotates in the clockwise direction around the shaft 23, and the detected piece 26D of the swing arm 26C of the driven rotation member 26 is removed from a detection position of the sensor 27.

Therefore, in a state in which each switching guide 18 is moved from the first transport position HS1 to the second transport position HS2, the driven rotation member 26 is at a position outside the standby position and the sensor 27 does not detect the detected piece 26D at the lower end of the swing arm 26C.

That is, as shown in FIGS. 7A and 7B, in a state in which each switching guide 18 is moved to the first transport position HS1 and the recording paper is not transported through the first transport path 8, the driven rotation member 26 is at the standby position and the sensor 27 detects the detected piece 26D at the lower end of the swing arm 26C. Moreover, in a state in which each switching guide 18 is moved to the first transport position HS1 and the recording paper is transported through the first transport path 8 as shown in FIGS. 8A, 8B, and 9 and a state in which each switching guide 18 is moved to the second transport position HS2 as shown in FIGS. 10A and 10B, the driven rotation member 26 is at a position outside the standby position and the sensor 27 does not detect the detected piece 26D at the lower end of the swing arm 26C.

Figure 11:
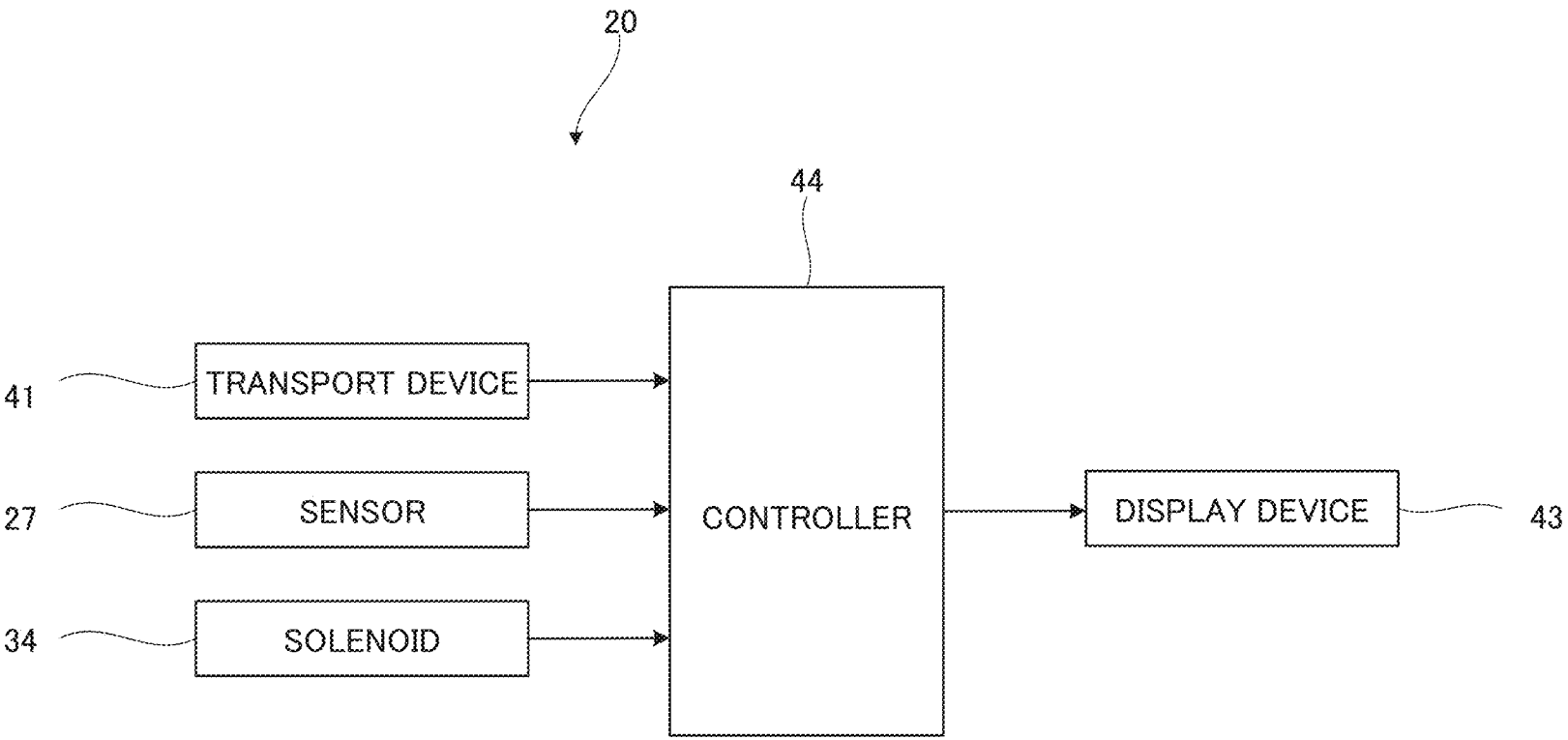
FIG. 11 is a block diagram schematically showing a configuration of a control system of the paper transport apparatus.

FIG. 11 is a block diagram schematically showing a configuration of a control system of the paper transport apparatus 20. As shown in FIG. 11, the paper transport apparatus 20 includes a transport device 41 configured to transport the recording paper P through the first transport path 8 or the second transport path 9, the solenoid 34, the sensor 27, a display device 43, and a controller 44.

The transport device 41 includes a motor, a clutch, and the like for rotating each transport roller in the first transport path 8, each transport roller in the second transport path 9, the ejection roller 16, and the like and transports the recording paper P through the first transport path 8 or the second transport path 9. As shown in FIGS. 4A and 4B, the solenoid 34 rotates each switching guide 18 and the first link member 24 in the counterclockwise or clockwise direction around the shaft 21 and positions each switching guide 18 at the first transport position HS1 or the second transport position HS2. The sensor 27 detects the detected piece 26D at the lower end of the swing arm 26C of the driven rotation member 26 and a detection output of the sensor 27 indicates that the driven rotation member 26 is at a standby position or a position outside the standby position.

The controller 44 controls the transport device 41 so that the recording paper P is transported through the first transport path 8 or the second transport path 9, activates or deactivates the solenoid 34 to switch each switching guide 18 to the first transport position HS1 or the second transport position HS2, and further determines that the driven rotation member 26 is at a standby position or a position outside the standby position on the basis of the detection output of the sensor 27.

Here, in order to appropriately control the recording paper transport operation of the paper transport apparatus 20, it is necessary to detect the presence or absence of recording paper being transported through the first transport path 8 and to detect that each switching guide 18 has been moved from the first transport position HS1 to the second transport position HS2 according to the activation of the solenoid 34. However, if a sensor for detecting the presence or absence of the recording paper and a sensor for detecting the second transport position HS2 of each switching guide 18 are provided separately, the cost increases.

Therefore, in the paper transport apparatus 20 of the present embodiment, while only the sensor 27 is provided, it is possible to determine both the presence or absence of recording paper and the second transport position HS2 of each switching guide 18.

Next, a control procedure for determining the presence or absence of recording paper P being transported through the first transport path 8 and the second transport position HS2 of each switching guide 18 will be described with reference to the flowchart shown in FIG. 12.

The controller 44 deactivates the solenoid 34 as shown in FIGS. 4A, moves each switching guide 18 to the first transport position HS1 as shown in FIGS. 7A and 7B (S101), determines that the driven rotation member 26 is at the standby position on the basis of the detection output of the sensor 27 (S102), and controls the transport device 41 so that the transport device 41 starts the transportation of the recording paper P (S103).

As shown in FIGS. 8A, 8B, and 9, when the recording paper P is transported through the first transport path 8, the tip of the paper detection member 25 is pushed up in contact with the recording paper P, the second link member 28 rotates in the clockwise direction with the paper detection member 25, the sliding contact surface 28A of the second link member 28 pushes away the bent inclined surface 26F of the contact arm 26B of the driven rotation member 26 in the right direction, the driven rotation member 26 rotates in the clockwise direction, and the swing arm 26C of the driven rotation member 26 is removed from a detection position of the sensor 27.

The controller 44 determines that the driven rotation member 26 is not outside of the standby position on the basis of the detection output of the sensor 27 before the recording paper P reaches the tip of the paper detection member 25 ("No" in S104), determines that the recording paper P is being transported through the first transport path 8 (S105) if the recording paper P reaches the tip of the paper detection member 25 and the driven rotation member 26 moves to a position outside the standby position ("Yes" in S104), starts the measurement of the elapsed time T (S106), determines whether or not the elapsed time T is greater than or equal to a prescribed time t (S107), and determines whether or not the driven rotation member 26 has returned to the standby position on the basis of the detection output of the sensor 27 (S108).

The prescribed time t is a period from the time when the tip of the paper detection member 25 is pushed up in contact with the recording paper P to the time when it returns to an original position (the time when the recording paper P passes through the position of the tip of the paper detection member 25) and is obtained in advance on the basis of the length of the recording paper P and the transport speed of the recording paper P.

For example, when the controller 44 determines that the driven rotation member 26 has returned to the standby position on the basis of the detection output of the sensor 27 ("Yes" in S108) before the elapsed time T is greater than or equal to the prescribed time t ("No" in S107), the recording paper P is normally transported, the rear end of the recording paper P passes through the position of the tip of the paper detection member 25, and the tip of the paper detection member 25 returns to its original position as shown in FIGS. 7A and 7B, such that it is determined whether or not there is printing on the back side of the recording paper P (S109) and it returns to the process from S103 when it is determined that there is no printing on the back side of the recording paper P ("No" in S109).

Figure 12:
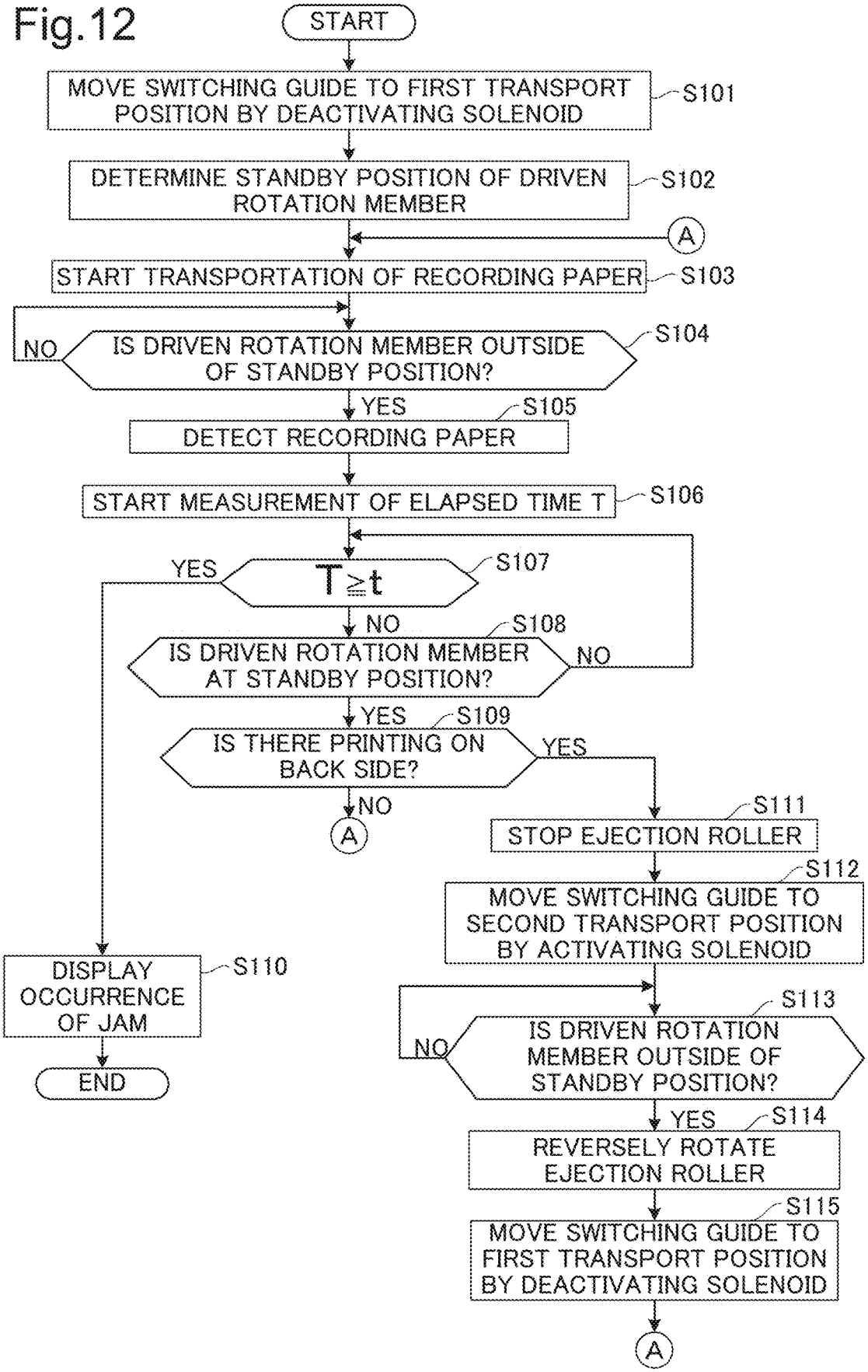
FIG. 12 is a flowchart showing a control procedure for determining the presence or absence of recording paper being transported through the first transport path and the second transport position of each switching guide.

Moreover, when the controller 44 determines that the driven rotation member 26 has not returned to the standby position ("No" in S108) and the elapsed time T is greater than or equal to the prescribed time t ("Yes" in S107), because the recording paper P is not transported normally, the rear end of the recording paper P does not pass through the position of the tip of the paper detection member 25, and there is a possibility that a jam will occur, the paper transport apparatus 20 is stopped and a message indicating the occurrence of the jam is displayed on the display device 43 (S110) and the control procedure shown in FIG. 12 ends.

Moreover, when it is determined that there is printing on the back side of the recording paper P ("Yes" in S109), the controller 44 controls the transport device 41 and stops the ejection roller 16 after a preset first time from a point in time when the driven rotation member 26 returns to the standby position on the basis of the detection output of the sensor 27, i.e., a point in time when the rear end of the recording paper P passes through the position of the tip of the paper detection member 25 (S111). Also, as shown in FIGS. 4B, the controller 44 activates the solenoid 34 to move each switching guide 18 to the second transport position HS2 as shown in FIGS. 10A and 10B (S112).

At this time, the first link member 24 rotates in the counterclockwise direction with each switching guide 18, the sliding contact surface 24A of the first link member 24 pushes away the smooth surface 26E of the contact arm 26B of the driven rotation member 26 in the right direction, the driven rotation member 26 rotates in the clockwise direction, and the detected piece 26D of the swing arm 26C of the driven rotation member 26 is removed from the detection position of the sensor 27.

If the controller 44 waits for the driven rotation member 26 to move to a position outside the standby position on the basis of the detection output of the sensor 27 ("No" in S113) simultaneously with the time when the solenoid 34 is activated and the driven rotation member 26 moves to a position outside the standby position ("Yes" in S113), each switching guide 18 is moved from the first transport position HS1 to the second transport position HS2, such that it is determined that each switching guide 18 has been moved from the first transport position HS1 to the second transport position HS2, the transport device 41 is controlled to reversely rotate the ejection roller 16 (S114), and the recording paper P is guided from the ejection roller 16 to the second transport path 9. Thereby, the recording paper P is transported in the switchback transport.

When a predetermined second time has elapsed after the reverse rotation of the ejection roller 16, the controller 44 stops the ejection roller 16, deactivates the solenoid 34 again, and moves each switching guide 18 from the second transport position HS2 to the first transport position HS1 as shown in FIGS. 7A and 7B (S115), confirms that the driven rotation member 26 is at a standby position on the basis of the detection output of the sensor 27, and returns to the process from S103.

As described above, in the present embodiment, the first link member 24, the paper detection member 25, the driven rotation member 26, the sensor 27, the second link member 28, and the like are used to determine the presence or absence of recording paper being transported through the first transport path 8 and the second transport position HS2 of each switching guide 18, it is possible to implement cost reduction without increasing the number of sensors.

On the other hand, in the case of a general paper transport apparatus other than the present embodiment, in a configuration in which a plurality of transport paths are provided and the transport path along which the paper is transported is switched by the branch pawl, it is necessary to detect the recording paper being transported through the transport path, the position the branch pawl, and the like and a configuration necessary for this detection is complex. For example, the number of motors, the number of solenoids, and the number of sensors increase and hence the cost also increases.

According to the present embodiment, in a mechanism for switching the paper transport direction, a constituent element for detecting the recording paper being transported through the transport path, the position of the branch pawl, and the like can be implemented with a simpler configuration.

Furthermore, the configuration and process of the above-described embodiment described with reference to FIGS. 1 to 12 are only one embodiment of the present disclosure and the present disclosure is not limited to the configuration and process.

While the present disclosure has been described in detail with reference to the embodiments thereof, it would be apparent to those skilled in the art that the various changes and modifications may be made therein within the scope defined by the appended claims.

What is claimed is:

1. A paper transport apparatus comprising:

a first transport path configured to guide paper;

a roller configured to transport the paper guided through the first transport path;

a second transport path configured to guide the paper transported in a direction opposite to a transport direction on the first transport path according to reverse rotation of the roller;

a switching guide rotationally supported according to a first shaft parallel to the roller and rotated back and forth around the first shaft to switch a transport direction of the paper by moving to either a first transport position for guiding the paper guided through the first transport path to the roller or a second transport position for guiding the paper transported in the opposite direction according to the reverse rotation of the roller to the second transport path;

a first link member rotatably supported by the first shaft and configured to protrude in a direction perpendicular to the first shaft and rotate back and forth integrally with the switching guide around the first shaft;

a paper detection member rotatably supported by a second shaft parallel to the first shaft, protruding toward the first transport path, and configured to rotate around the second shaft and retreat from the first transport path when the paper detection member comes into contact with the paper transported through the first transport path;

a second link member rotatably supported by the second shaft and configured to rotate integrally with the paper detection member around the second shaft when the paper detection member retreats from the first transport path;

a driven rotation member rotatably supported by a third shaft parallel to the first shaft, pressed and rotated by the first link member when the switching guide is switched to the second transport position and the first link member rotates, and pressed and rotated by the second link member when the paper detection member retreats from the first transport path and the second link member rotates;

a sensor configured to detect a standby position of the driven rotation member when the driven rotation member is not pressed by either the first link member or the second link member;

a drive device configured to rotate the switching guide back and forth around the first shaft and switch the switching guide to either the first transport position or the second transport position; and a controller configured to determine that the paper is being transported through the first transport path when the paper detection member retreats in contact with the paper transported through the first transport path in a state in which the switching guide is switched to the first transport position by controlling the drive device, the second link member rotates, the driven rotation member is pressed and rotated by the second link member, and the standby position of the driven rotation member is not detected by the sensor and determine that the switching guide has been switched from the first transport position to the second transport position when the first link member rotates with the switching guide after the switching guide is switched to the second transport position by controlling the drive device, the driven rotation member is pressed and rotated by the first link member, and the standby position of the driven rotation member is not detected by the sensor.

2. The paper transport apparatus according to claim 1, wherein the controller switches the switching guide to the second transport position by controlling the drive device if it is determined that there is printing on a back side of the paper when the paper detection member retreats in contact with the paper transported through the first transport path in the state in which the switching guide is switched to the first transport position by controlling the drive device, the second link member rotates, the driven rotation member is pressed and rotated by the second link member, and a state in which the standby position of the driven rotation member is not detected by the sensor ends in less than a prescribed time.

3. The paper transport apparatus according to claim 1, wherein the controller determines that a jam has occurred when the paper detection member retreats in contact with the paper transported through the first transport path in the state in which the switching guide is switched to the first transport position by controlling the drive device, the second link member rotates, the driven rotation member is pressed and rotated by the second link member, and a state in which the standby position of the driven rotation member is not detected by the sensor continues for a prescribed time or longer.

4. The paper transport apparatus according to claim 3, wherein the controller calculates the prescribed time on the basis of a length of the paper in a transport direction and a transport speed of the paper.

5. An image forming apparatus comprising:

the paper transport apparatus according to claim 1; and an image forming device configured to form an image on the paper transported by the paper transport apparatus.

* * * * *